US005447387A

United States Patent [19]

Fagan

[11] Patent Number: 5,447,387

[45] Date of Patent: Sep. 5, 1995

[54] TRACTION PROVIDING DEVICE(S) FOR OPEN GRID BRIDGES AND METHODS OF USE

[76] Inventor: Thomas Fagan, 22 Monatiquot St., Weymouth, Mass. 02191

[21] Appl. No.: 123,878

[22] Filed: Sep. 20, 1993

[51] Int. Cl.[6] ..... E01C 9/10; E01C 11/24

[52] U.S. Cl. ..... 404/20; 14/73; 52/181

[58] Field of Search ..... 404/19, 20, 21, 82, 404/28; 14/73; 52/177, 181, 667

[56] References Cited

U.S. PATENT DOCUMENTS

| | | | |
|---|---|---|---|
| 1,665,846 | 4/1928 | Denni | 52/181 |
| 2,009,595 | 7/1935 | Van Der Pyl | 52/181 |
| 2,031,007 | 2/1936 | Schulz | 52/181 |
| 2,960,918 | 11/1960 | Nagin | 404/19 X |
| 3,156,168 | 11/1964 | Nagin et al. | 404/21 |
| 4,555,292 | 11/1985 | Thompson | 52/181 X |

FOREIGN PATENT DOCUMENTS

| | | | |
|---|---|---|---|
| 2519115 | 7/1983 | France | 404/19 |

*Primary Examiner*—Ramon S. Britts
*Assistant Examiner*—James A. Lisehora
*Attorney, Agent, or Firm*—Gregory B. Butler

[57] ABSTRACT

The invention pertains to a device which, when inserted and affixed to an open grid deck spaces of an open grid bridge, provides increased traction for trespassing motor vehicles. The invention also pertains to methods of affixing the traction providing devices in various spacial arrangements.

2 Claims, 3 Drawing Sheets

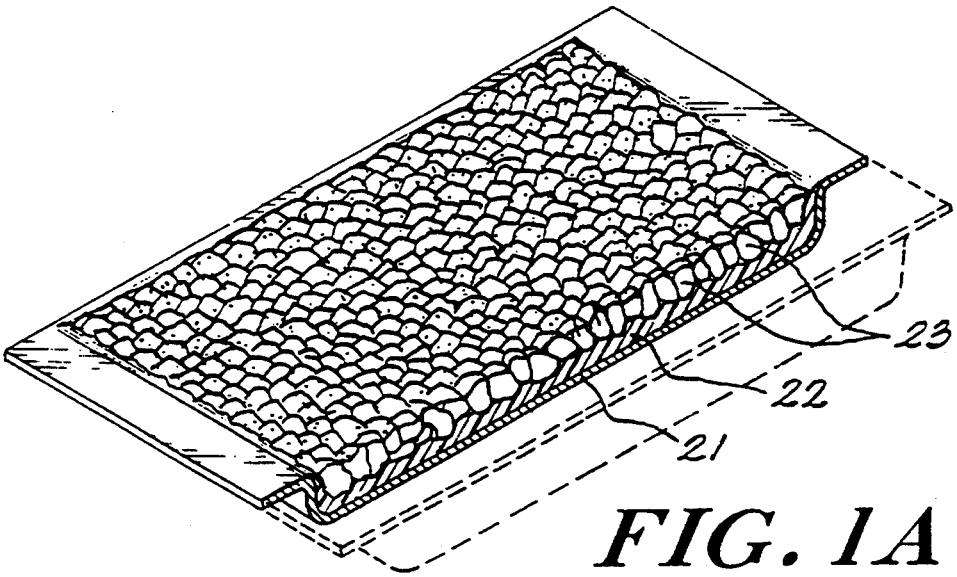
FIG. 1A
FIG. 1B
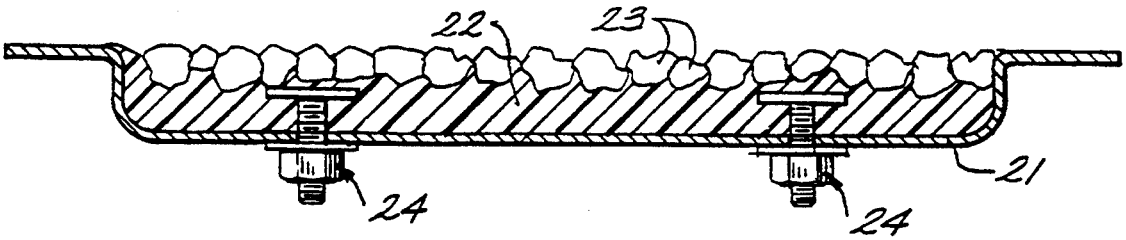
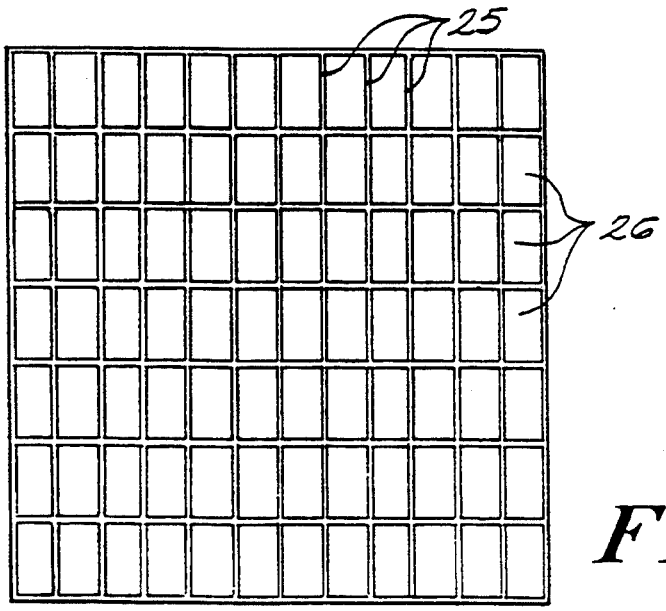
FIG. 2A

TRACTION PROVIDING DEVICE(S) FOR OPEN GRID BRIDGES AND METHODS OF USE

BACKGROUND

Bridges provide a passageway for people, vehicles and/or materials. There are many different types and designs of bridges, including beam bridges, arch bridges and suspension bridges. From a historical perspective, the moveable bridge is one of the more recent developments in the design of bridges. Moveable bridges, also known as drawbridges, number approximately 2800 throughout the United States. Drawbridges are unique from other types of bridges in that the moveable span(s) or module(s) of the draw bridge is comprised an open grid deck structure. This framework of open grid bars is composed of steel and provides a stable load-bearing structure. It offers the advantages of being relatively light weight (i.e., minimal dead load) compared to solid concrete/steel structures and has low impedence or resistance to the flow of air or wind currents when the drawbridge is in the opened position. The open grid structure also offers a free-draining surface for water drainage during wet seasons. Open grid deck systems have found other applications in other types of load-bearing structures across the country, including bridge overpasses and railroad crossings, numbering over 3200 and 280,000 respectively in the United States.

This open grid deck structure, however, presents a significant safety concern for motorists. In times of wet weather during rain or snow, the steel framework surface of the open grid deck structure becomes very slippery and promotes fish-tailing and skidding of motor vehicles. As a consequence, hundreds of automobile accidents occur, yearly, on open grid systems throughout the United States. Many of these accidents involve fatalities. Undoubtedly, society would be greatly benefitted by safer bridges with open grid deck structures that provide a greater degree of traction for motor vehicle tires during periods of wet weather or other adverse conditions, such as gasoline and oil spills.

SUMMARY OF THE INVENTION

The present invention pertains to a traction providing device for an open grid bridge comprising an affixable insert for the open spaces of the open grid deck framework structure of an open grid bridge, wherein the insert provides traction for motor vehicle tires. A preferred embodiment of the invention pertains to a traction providing device comprised of 1) a lower insert pan with the size, shape and dimension corresponding to the framework open spaces of the grid deck structure of said open grid bridge with at least two extended edges for affixation to said open grid bridge, 2) an upper aggregate capable of providing traction with the surfaces of motor vehicle tires, and 3) a middle adhesive agent capable of bonding the lower insert pan and the upper aggregate.

The invention also pertains to a method(s) of enhancing or increasing the traction of an open grid bridge surface comprising the affixation of traction providing devices to the individual open spaces of the grid deck structure of the open grid bridge. This affixation can occur in a checkerboard pattern of alternating traction providing devices and open grid deck spaces. The checkerboard pattern can be comprised of rows with various widths, perpendicular to the flow of motor vehicle traffic. These perpendicular rows of traction providing devices can be separated by varying distances along the span(s) or module(s) of an open grid bridge without traction providing devices.

The device and methods of affixation provide enhanced or increased traction to the surface of open grid bridges. This traction providing device imparts safety to the bridge while 1) not imposing significant weight gain, 2) not increasing the air flow resistance of the bridge span(s) or module(s) and 3) not impeding water drainage from the surface. Motor vehicles can travel open grid bridges with greater safety at times when the open grid deck structure is wet and/or slippery due to rain, snow or other adverse conditions which lower skid resistance, such as gasoline and oil spills.

BRIEF DESCRIPTION OF THE FIGURES

FIG. 1 represents cross-sectional views of traction providing devices with a) being a cross section of a traction providing device comprised of the lower insert pan (#21) with two extended edges for affixation to an open grid bridge, an upper aggregate(#23) capable of providing traction with the surfaces of the motor vehicle tires and a middle adhesive agent(#22) capable of bonding the lower pan and the upper aggregate; and b) a cross-section of a traction providing device comprised of the same components of the device of FIG. 1A, but in addition the lower insert pan has two, recipient holes as spaces for two, respective sets (#24) of a bolt, washer and screw, inserted and secured before the application of the middle adhesive agent.

DETAILED DESCRIPTION OF THE INVENTION

Figure 2B:
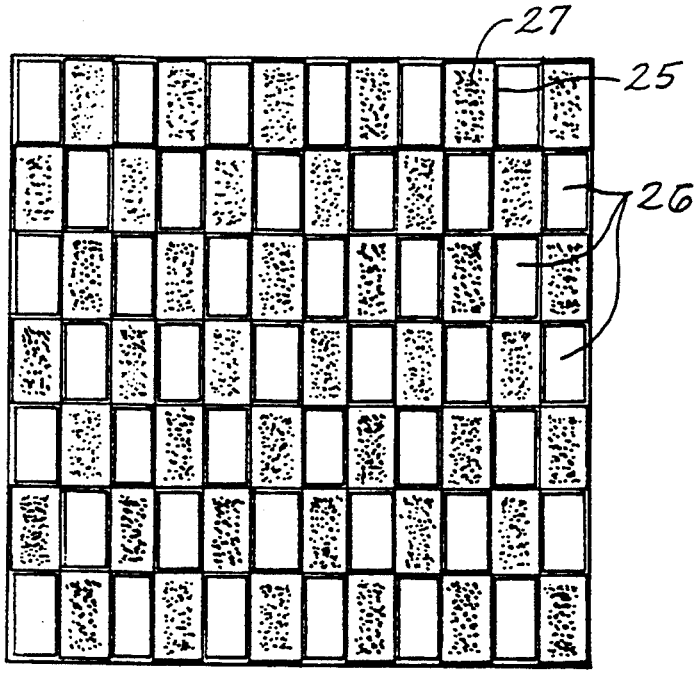
FIG. 2 represents two examples of the traction providing devices as they are affixed to the open grid bridges with; a) a steel open grid deck system without traction providing devices, with grid bars (#25) and open deck spaces (#26); b) a checkerboard pattern of alternating, singular traction providing devices (#27) and open grid spaces of an open grid bridge; and c) a checkerboard pattern of alternating, triplet traction providing devices (#28) and triplet open grid spaces of an open grid bridge.

This invention pertains to traction providing devices which when inserted in the open deck spaces and affixed to open grid bridges results in enhanced or increased surface traction and skid resistance for trespassing motor vehicles. The invention also pertains to methods of affixing the traction providing devices to the open grid bridges in various spacial patterns and/or arrangements.

Open Grid Bridges:

Open grid bridges are comprised of spans or modules of steel bars connected to one another in such a way as to create a framework of steel grids with open spaces. The characteristics of these bridges include strength and stability imparted by the steel, as well as, low relative weight and low wind resistance due to the absence of being a solid structure (i.e., open spaces between the grid bars). The steel grid bars can be connected to one another and arranged to give various shapes to the open spaces, such as squares, rectangles and triangles. The size of the open spaces can also vary, typically ranging between one (1) and ten (10) square inches.

Traction Providing Devices:

A preferred embodiment of the invention is comprised of a lower insert pan with the size, shape and dimension corresponding to the framework open spaces of the grid bar structures of an open grid bridge with at least two extended edges for affixation to the open grid bridge; an upper aggregate capable of traction with the surface of motor vehicle tires; and a middle adhesive agent capable of bonding the lower pan and the upper aggregate.

A) Lower Insert Pan

The lower insert pan can be comprised of any material which can be affixed to the steel bars of an open grid bridge, as well as, bond to an adhesive agent which, in turn, is also capable of bonding an upper aggregate. Typically, the insert pan is comprised of steel or a steel alloy. In a preferred embodiment, the insert pan is comprised of cold rolled steel. The thickness of the pan can be within a range of 0.025 to 0.50 inches, with the preferred embodiment being 0,065 inches in thickness. The cold steel is cut and folded to create a depression which can be folded to different depths. The depths can range from 0.1 to 3.0 inches. The steel is further folded to create at least two extended edges measuring between 0.25 and 1.00 inches. These edges are required for the affixation of the traction providing devices to the steel bars of an open grid bridge. The shape of the lower insert pan corressponds to the shape of the open deck spaces between the open grid bars, as mentioned above, typically, squares, rectangles or triangles.

Alternatively, the depressed or bottom portion of the insert pan can have one or more holes for which a fastening device can be inserted and secured (e.g., bolted) before the application of the middle adhesive agent. The fastening device is comprised of a head element which is positioned within the depressed portion of the pan with a lower segment extending through the hole(s) and an outer securing element positioned beneath the pan. In a preferred embodiment of the invention, the fastening device is comprised of a bolt, washer and nut (see FIG. 1B). The head of the fastening device (e.g., bolt) can be of varying size to engage varying amounts of surface area coated by the middle adhesive agent and is positioned above, but not in contact with the surface of the pan bottom to allow the adhesive agent to flow around the head and bond contiguously above and beneath the head element (see FIG. 1B). The purpose of the fastening device is to add greater strength to the cured bond between the steel of the lower pan and the middle adhesive agent.

B. Upper Agreggate

The upper aggregate can be comprised of any material which is skid resistant and can provide traction for motor vehicles. Traction is defined as frictional resistance between two surfaces. In the present case, the frictional resistance is between motor vehicle tires and the upper aggregate. The aggregate must be capable of bonding with an adhesive agent which, in turn, can also bond with the lower insert pan. The aggregate can be smooth, such as poured or layered concrete or coarse, such crushed rock or stone. Forms of aggregate include silica sand, DYNAGRIP ® (Fosroc, Inc., New York, N.Y.) and calcined bauxite. The aggregate can be iron (i.e., ferrous) containing or non-iron containing. Nonferrous containing aggregates offer the advantage of being spark resistant which is preferable since surfaces used by motor vehicles can often contain spills of ignitable substances such as gasoline and oil. The preferred aggregate for the present invention is FOSROC Aggregate No.8 (Fosroc, Inc., New York, N.Y.).

C. Middle Adhesive Agent

An adhesive agent can be defined as a material which, when applied to surfaces, can join them together and resist their separation. Thus, adhesive is a general term used for substances capable of holding materials together by surface attachment. In the present invention, an adhesive agent can be any material or substance which can bond to the surface of the lower insert pan and the surfaces of the upper aggregate, thereby holding the pan and aggregate together and resisting their separation. Examples of adhesive agents include thermosetting materials, which, when cured, form molecular chains that are locked permanently together in a large three-dimensional structure. (*Adhesives in Civil Engineering* by G. C. Mays and A. R. Hutchinson, Cambridge University Press, 1992; hereby incorporated by reference) Epoxides, phenolic resins and polyesters are examples of thermoserring agents. As structural adhesives, epoxies are most widely accepted and used. They typically contain several components, the most important being the resin. To the base resin is added a variety of materials, for example, hardeners, flexibilizers, tougheners and filler. These all contribute to the properties of the resulting adhesive. Formulations can be further varied to allow for curing at ambient or elevated temperatures. Epoxides are generally tolerant of many surface and environmental conditions, possess relatively high strength and shrink very little on curing. Epoxy adhesives are available as one, two or three component materials in liquid, paste or filmic form. The preferred embodiment of the present invention is an epoxy resin known as CICOL ET SLURRY TM (Fosroc, Inc., 55 Skyline Drive, Plainview, N.Y. 11803-9966). CICOL ET SLURRY TM is a solvent-free, three component system that includes coal tar modified epoxy resins, amine curing agents and chemically inert, graded silica filler which when mixed forms a fluid, homogenous slurry.

Manufacture of Traction Providing Device(s)

The manufacture of the traction providing device(s) is comprised of assembling the three major components (i.e., lower insert pan, upper aggregate and middle adhesive agent) into a single unit. The specifications of the lower insert pan are determined from the shape, size and dimension of the open grid spaces of the open grid bridge for which the traction providing devices are to be affixed. These specifications include the length and width of the pan, the depth of the pan depression, the length of the extended edges and the thickness of the metal. Once the specifications are determined, the lower insert pans are cut and folded from sheet metal to conform to those specifications.

The formed lower insert pans are pretreated to clean the surface of the metal, remove contaminants and increase the roughness and square area for contact with the adhesive agent. Abrasive treatment, such as, sand blasting is on the whole the best for preparing plain-carbon steel. Any obvious rust or millscale should be removed and the pans degreased. The standard of cleanliness for the pretreated steel should be a minimum SSPC6 (Commercial Blast Cleaning). Generally, the steel surface should be clean, dry, free from oils, grease and all loose and unsound material.

The middle adhesive agent is prepared by mixing the components and adding the fillers until a homogenous consistency is formed. The time elapsed between surface pretreatment and application of the adhesive agent should generally be kept as short as possible because surface energies are lowered by the adsorption of atmospheric moisture and contaminants. Consequently, the prepared adhesive agent should be applied to the pretreated lower insert pans to the desired thickness, as soon as possible. Use of a wet film gauge can be used to ensure the correct thickness. Prior to applying the adhesive agent, the extended edges of the insert pans are covered to prevent them from being coated with the adhesive. The covering must be removed before the adhesive agent is cured. If the lower insert pans contain one or more holes for one or more fastening devices, the devices must be positioned in the holes and secured before the application of the middle adhesive agent.

The chosen upper aggregate must be applied to saturation (i.e., surface is completely covered) immediately after applying the adhesive agent. The aggregate is applied so that the aggregate particles only partially sink into the adhesive agent to give the appropriate degree of embedment for both adhesion and skid resistance (i.e., traction). The adhesive agent is allowed to cure for a sufficient time period for that particular agent, readily discoverable by one of ordinary skill in the art. In the preferred embodiment of the present invention, CICOL ET SLURRY TM is allowed to cure for 24 hrs at 68 degrees Farenheit.

Following the curing period, excess aggregate can be removed by brushing and the bottoms of the pans are coated with an inorganic paint for rust resistance. The manufacture of the traction providing device(s) is complete and they are ready for affixation to open grid bridges.

Figure 2C:
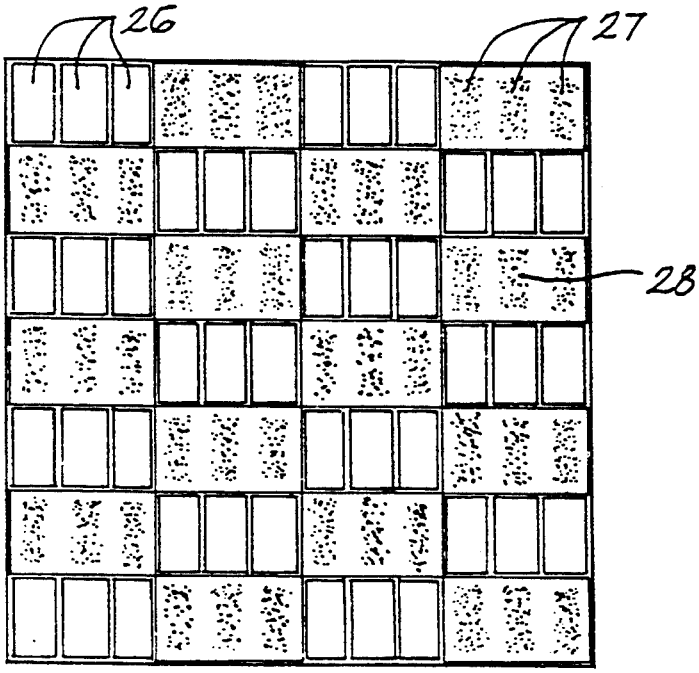
Figure 3:
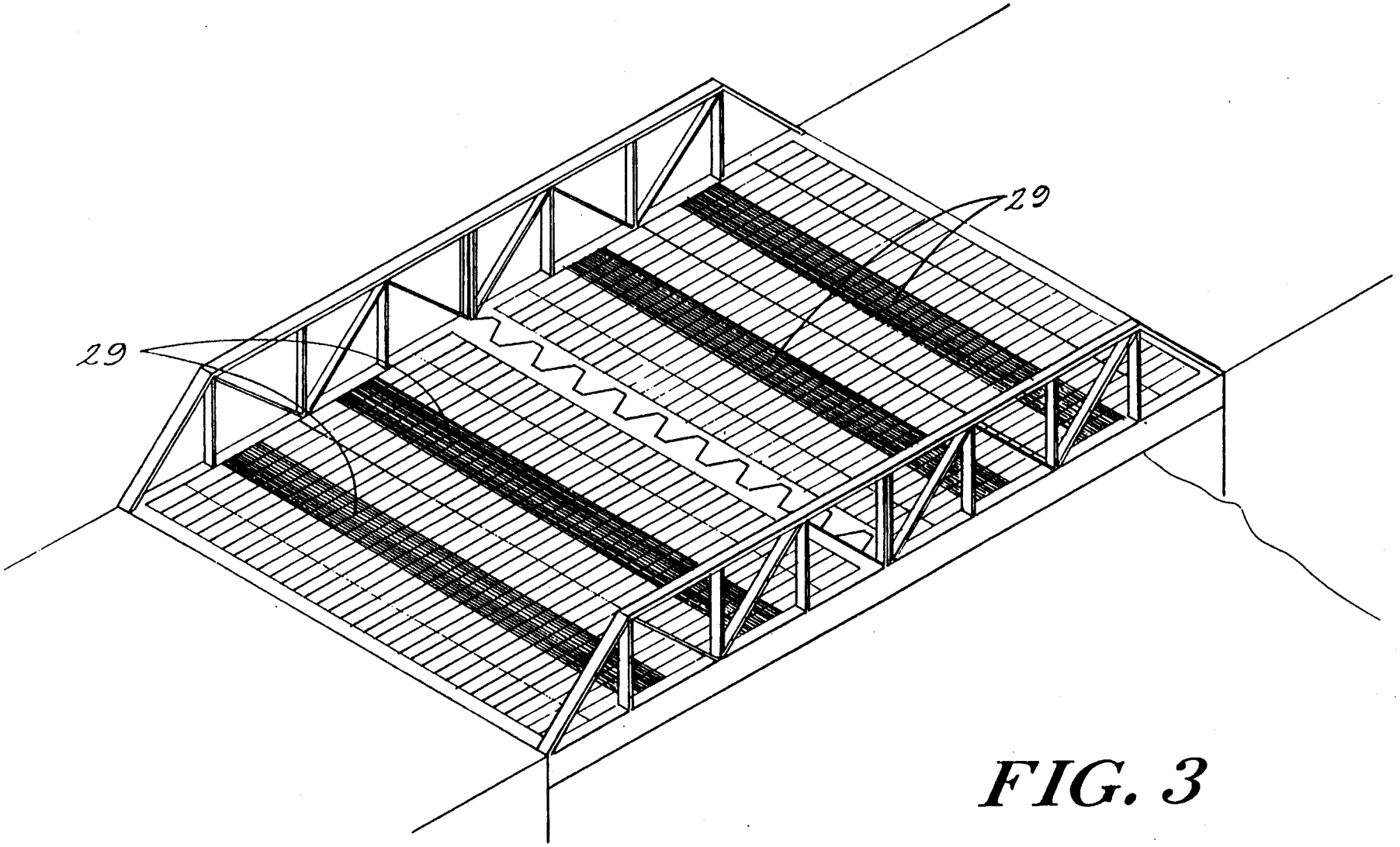
FIG. 3 represents an example of an overall arrangement of three foot wide rows of affixed traction providing devices, perpendicular to the flow of traffic across the span(s) or module(s) of an open grid bridge.

Methods of Use:

The framework of the open grid bars and the open grid spaces of open grid bridges can occur as squares, rectangles and/or triangles. The affixation of the traction providing devices to the open grid bars and spaces can occur in any spacial arrangement or pattern, including affixation to all or only some open grid spaces. A preferred embodiment of the present invention is an arrangement of devices such that the affixation occurs in an alternating fashion between affixed devices and open grid spaces to which devices are not affixed (i.e., checkerboard pattern, see FIGS. 2B and 2C). The arrangement of alternating devices and open spaces typically occurs over three foot sections of the bridge surface, throughout the width of the bridge and perpendicular to the flow of traffic (see FIG. 3). These three foot sections of affixed traction providing devices can occur throughout the length of the open grid bridge separated by variant or invariant lengths of unaffixed areas of bridge surface. The variance in the length of these areas can be from zero to five hundred (500) feet. In a preferred embodiment, the length of unaffixed open grid deck spaces between areas with affixed traction providing devices is five (5) to ten (10) feet, equaling the approximate distances between the axles of motor vehicles. Alternatively, the traction providing devices can be affixed as sets of two or more devices, alternating with one or more open grid spaces.

The method of affixation of the extended edges of the devices to the open grid bars is dependent on the material comprising the lower insert pan. In a preferred embodiment of the present invention, the lower insert pans are comprised of steel and the extended edges are affixed by welding to the open grid bars. In any case, the affixation occurs so that the traction providing devices are inseparable from the open grid bars.

The invention is further illustrated by the following specific examples, which are not intended to be limiting in any way.

EXAMPLIFICATION

Example 1: Process of Manufacturing Fraction Providing Devices

The following steps are required for the manufacture of traction providing devices:

1. The insert pans are cut out of sheet metal and folded to a specification of 0.065 inches thick, cold rolled steel. The insert depression measures 5/16 of an inch.
2. The insert pans are pretreated with sandblasting to rough up the upper surface of the pans and thereby increase the surface area available for contacting and bonding with the epoxy;
3. The pans are laid out side by side on a specially fitted table with each table holding approximately 360 insert pans, in 6 rows of 60;
4. The extended edges of the insert pans, used for affixation to the open grid bridge, are covered with duct tape to prevent coverage with epoxy. The tape must be removed before the epoxy coating is cured;
5. Fosroc® CICOL ET SLURRY TM is mixed and applied to the pans filling the depression in the pan to a thickness of approximately 3/16 of an inch;
6. Fosroc® Aggregate #8 is applied to the layer of CICOL ET SLURRY TM to cover the entire surface of the exposed slurry;
7. One (1) hour after the application of the aggregate, the duct tape is removed, the pans are removed and allowed to cure for twenty-four (24) hours at ambient temperatures; and
8. Excess CICOL ET SLURRY TM is wirebrushed off of the pans and the bottoms of the pans are coated with an inorganic paint. The manufacture of the traction providing devices is complete and they are ready for affixation to open grid bridges.

Example 2: The Affixation of Traction Providing Devices to the Fore River Bridge The Fore River Bridge is a drawbridge located in Quincy, Mass. It is comprised of movable spans or modules which allow for passage of navigable vessels beneath and through the bridge. The traction providing devices were welded to the open grid spaces of the grid deck of each bridge span. The arrangement of welded devices occured in a checkerboard pattern of three foot wide sections, perpendicular to the direction of traffic flow and throughout the width of the bridge. The three foot wide sections were separated by six foot wide sections to which devices were not affixed. This six foot separation provided for the closest arrangement of tires to sections with traction providing devices for trespassing vehicles with two axles.

Equivalents

Those skilled in the art will recognize, or be able to ascertain using no more than routine experimentation, many equivalents to the specific embodiment of the invention described specifically herein. Such equivalents are intended to be encompassed in the scope of the following claims.

I claim:

1. A traction providing device for a bridge deck of a type having a plurality of interconnected grid bars forming therebetween a plurality of framework openings of uniform shapes and dimensions, said traction providing device comprising;

a) a lower insert pan having a shape and dimensions corresponding to the shape and dimensions of the framework openings, said lower insert pan having at least two extended edges for extending over and being affixed to said grid bars, and said lower insert pan further comprising a depressed portion between said extended edges;

b) an upper aggregate capable of providing traction with motor vehicle tires;

c) a middle adhesive agent located in said depressed portion and bonding said upper aggregate to said lower insert pan;

d) at least one recipient hole provided in said lower insert pan; and e) at least one fastening device extending through said at least one recipient hole and securing said middle adhesive agent to said lower insert pan, said at least one fastening device comprising a head element which is positioned within the middle adhesive agent, a lower segment extending through said at least one recipient hole, and an outside securing element positioned beneath the pan.

2. A traction providing device of claim 1, wherein said head and lower segment is a bolt and said outside securing element is a nut with a washer.

* * * * *